US008177936B2

(12) United States Patent
Berghaenel

(10) Patent No.: US 8,177,936 B2
(45) Date of Patent: May 15, 2012

(54) DEVICE FOR EVAPORATING CALCIFEROUS WATER BY MEANS OF ELECTRICAL HEATING

(76) Inventor: Dietmar Berghaenel, Chemnitz (DE)

( * ) Notice: Subject to any disclaimer, the term of this patent is extended or adjusted under 35 U.S.C. 154(b) by 396 days.

(21) Appl. No.: 12/387,628

(22) Filed: May 5, 2009

(65) Prior Publication Data

US 2009/0283253 A1 Nov. 19, 2009

(30) Foreign Application Priority Data

May 8, 2008 (DE) ..... 10 2008 022 837
Aug. 5, 2008 (DE) ..... 20 2008 010 805 U

(51) Int. Cl.

| | |
|---|---|
| ***B01D 1/20*** | (2006.01) |
| ***B01D 3/42*** | (2006.01) |
| ***C02F 1/04*** | (2006.01) |
| ***G05D 23/00*** | (2006.01) |
| ***H05B 1/02*** | (2006.01) |

(52) U.S. Cl. ..... 159/44; 159/48.1; 159/DIG. 1; 159/DIG. 15; 159/DIG. 41; 165/287; 219/494; 392/394; 202/160; 202/267.1

(58) Field of Classification Search ..... 159/3, 44, 159/48.1, 901, DIG. 1, DIG. 15, DIG. 41; 165/287; 219/201, 494, 538; 392/394; 202/160, 202/267.1

See application file for complete search history.

(56) References Cited

U.S. PATENT DOCUMENTS

| | | | | |
|---|---|---|---|---|
| 2,815,593 | A * | 12/1957 | Reimers et al. | 38/77.6 |
| 3,536,591 | A * | 10/1970 | Lotz | 202/174 |
| 5,054,105 | A * | 10/1991 | Kiyimaa et al. | 392/394 |
| 7,731,822 | B2 * | 6/2010 | Smith | 203/1 |
| 2003/0031588 | A1 * | 2/2003 | Schur | 422/28 |
| 2006/0222348 | A1 * | 10/2006 | Rosenzweig et al. | 392/441 |
| 2008/0128094 | A1 * | 6/2008 | Fukuda | 159/6.1 |
| 2009/0020232 | A1 * | 1/2009 | Wolfe et al. | 159/6.2 |
| 2009/0199972 | A1 * | 8/2009 | Lakatos et al. | 159/3 |

FOREIGN PATENT DOCUMENTS

| | | |
|---|---|---|
| DE | 697 08 943 | 4/2002 |
| DE | 103 58 940 | 6/2005 |
| DE | 10 2005 048 768 | 4/2007 |
| DE | 10 2006 020 280 | 11/2007 |
| DE | 20 2007 014 365 | 3/2009 |
| EP | 1 544 539 | 6/2005 |

* cited by examiner

*Primary Examiner* — Virginia Manoharan
(74) *Attorney, Agent, or Firm* — Jordan and Hamburg LLP

(57) ABSTRACT

Evaporation of calciferous water is performed by an evaporator using electrical heating. An injection nozzle is connected to a spray hose arranged in an upper third of the evaporator, immediately above a thermostat that is disposed on the bottom side of the evaporator. A distance between the injection nozzle and the thermostat is less than 15 mm. A steam hose is connected to the evaporator via a steam connector. The steam connector has an inside diameter of at least 5 mm. The steam hose leads to a collector situated at an angle of inclination of 5° to 10°.

9 Claims, 1 Drawing Sheet

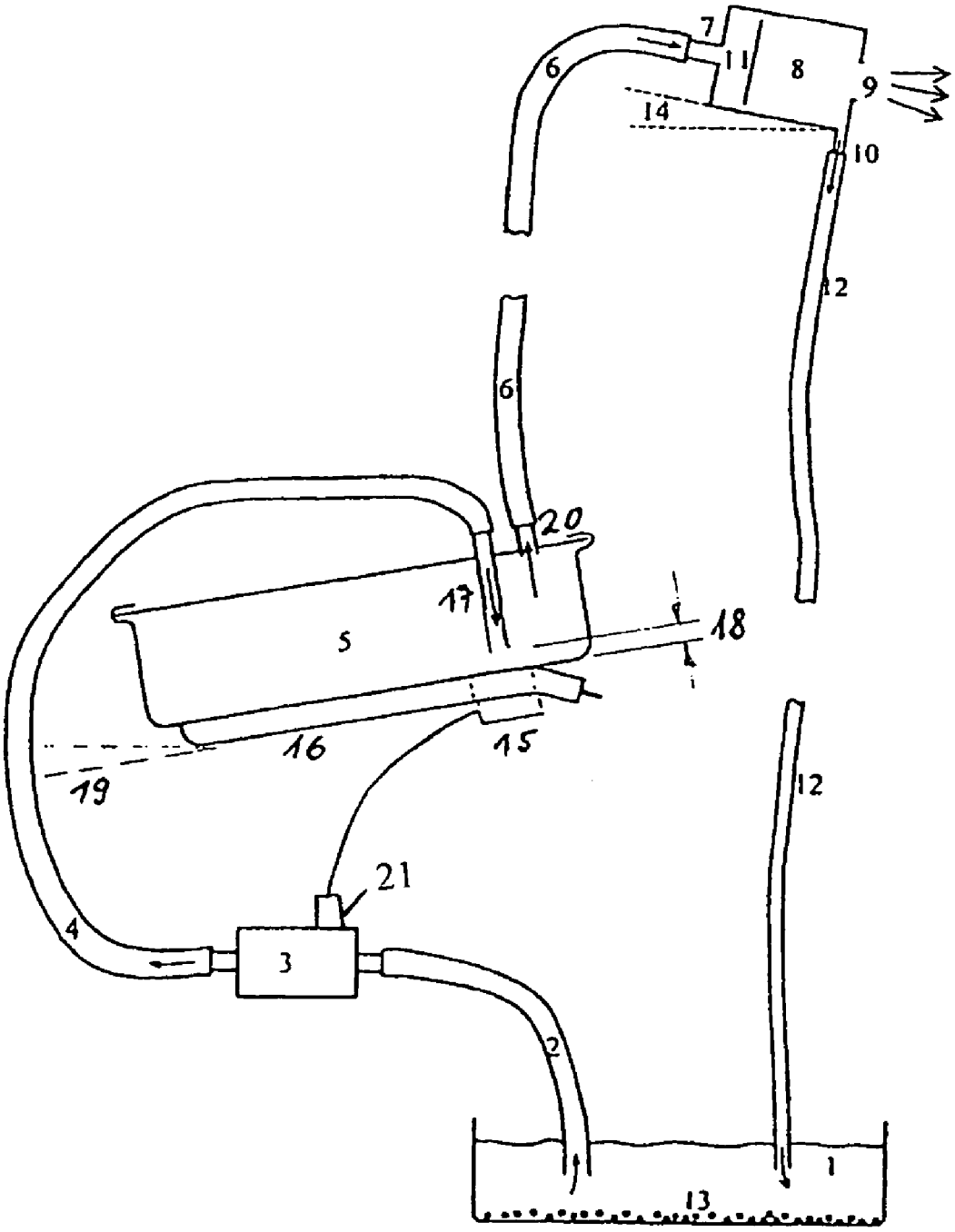
7
11
8
9
6
14
10
12
6
20
17
18
5
16
15
19
12
21
4
3
2
1
13

DEVICE FOR EVAPORATING CALCIFEROUS WATER BY MEANS OF ELECTRICAL HEATING

BACKGROUND OF THE INVENTION

The invention relates to an apparatus for evaporating calciferous water by means of electrical heating, in particular for use in electrical household appliances and power tools, in which the steam is conducted using a hose or tubing to a collector that is spaced from the steam generator.

In a steam generator that works at atmospheric pressure, as is known from DE 69708943 T2, the solution for industrial application is regularly scheduled maintenance for decalcification. Maintenance-free operation of this steam generator for its entire service life is not possible.

Known from DE 10358940 A1 is generating steam, free of droplets, using a minimum number of components. When a hose or tubing is used to conduct the steam to a location that is spaced from the steam generator, with a solution like this it is disadvantageous that condensate forms in the hosing or tubing. This condensate leads to undesired droplet formation in the steam. It is possible to use a nozzle at the steam outlet to atomize the water droplets with the steam, which at this location has a very high velocity. However, this changes the pressures in the system in such a disadvantageous manner that technical safety components and pressure-resistant construction speak against it and solid constituents that loosen from mineral deposits in the evaporator clog the nozzle after a brief operating period.

Known from DE 10 2005 048 768 C2 is an apparatus for evaporating water by means of electrical heating for droplet-free steam generation in which a water container is connected to an evaporator via a water hose, a pump, and a spray hose, the evaporator being connected via a steam hose to a pipe connector for an externally arranged collector and being attached to a return connector on the bottom side of the collector. The bottom side of the collector is at an angle of inclination of 5° to 10° relative to the horizontal. A return hose that leads to the water container is arranged at the return connector. It is disadvantageous in this solution that calciferous water residue forms in the evaporator and after an extended operating period this can lead to functional problems.

SUMMARY OF THE INVENTION

The object of the invention is to provide an apparatus for evaporating calciferous water by means of electrical heating, with which device in the most simple and unpressurized manner droplet-free steam is generated for use in electrical household appliances and power tools and in which device the minerals that are contained in the steam, for instance due to calciferous water residue that has deposited, are separated out upstream of the steam outlet.

The advantages of the invention are comprised in that steam is generated from calciferous water in the simplest manner, unpressurized and free of droplets, and the function of the evaporator is not negatively affected due to mineral deposits. Another advantage is that mineral residue is separated from the evaporator, collected in a container, and thus self-cleaning is provided by the system.

BRIEF DESCRIPTION OF THE DRAWINGS

The drawings is a schematic illustration of an embodiment of the invention.

DETAILED DESCRIPTION OF THE INVENTION

The invention shall be explained in greater detail in the following using an exemplary embodiment. The drawing associated with this exemplary embodiment depicts the principle for the structure of the evaporator connected to all of the components.

Disposed in a water container 1 is the water to be evaporated, which is drawn through a water hose 2 by a pump 3 and injected into an evaporator 5 via an spray hose 4 and an injection nozzle 17, the evaporator 5 being arranged at an angle of inclination 19 of 5° to 10°.

The injection nozzle 17 is advanced towards the floor of the evaporator 5 to a distance 18 that is less than 15 mm, preferably 5 to 10 mm therefrom. Disposed on the bottom side of the evaporator 5 beneath the injection nozzle 17 is a temperature regulating device 15, for example a conventional thermostat, that switches a heating unit 16. Thus the water that is injected reliably acts on the thermostat 15 thermally without a temporal delay. Alternatively, the temperature regulating device can be an electronic sensor which switches an electronic switch 21 with which the pump 3 is provided. The injected water runs downward on the angle of inclination 19 of the evaporator 5, which in the exemplary embodiment is approximately 8° , over its floor surface. The smooth floor surface of the evaporator 5 and the thermally induced expansion of all of the parts cause mineral residue to flake off and prevent the formation of mineral bridges between the injection nozzle 17 and the evaporator 5. The steam leaves the evaporator 5 via a steam connector 20.

The thermostat 15, injection nozzle 17, and steam connector 20 are disposed in the upper third of the evaporator 5. The steam generated in the evaporator 5 flows via a steam hose 6 and a pipe connector 7 into a collector 8 and is available droplet-free at an opening 9 of the collector 8. The collector 8 is a hollow body in a round or square shape. Droplets that form from condensate in the steam hose 6 and dissolved mineral residue 13 that is from the evaporator 5 and that is contained in the steam are precipitated in the collector 8 and, due to an angle of inclination 14 relative to the horizontal, which angle is approximately 5° to 10°, are conducted into the water container 1 via a return connector 10 and a return hose 12. A baffle 11 can be provided in the collector 8 for aiding precipitation. While the water droplets in the water container 1 are returned for re-evaporation, mineral residue 13 settles on the floor of the water container 1. The mineral residue 13 can be removed when the water container 1 is re-filled. Mineral residue remaining in the collector 8 is removed by rinsing with water or opening and cleaning the collector 8.

In an evaporator 5 having a power of 2 kilowatts, it is customary to use a steam hose 6 that has an inside diameter of 5 millimeters. In this case the evaporator 5 is unpressurized even if the steam connector 20 has at least this inside diameter. The injection nozzle 17 is not critical in terms of pressure, but should have an inside diameter of less than or equal to 5 mm to assure that the system functions reliably. If the diameter of the injection nozzle 17 is larger, it is advantageous to reduce this cross-section appropriately on the side facing the thermostat 15 by deformation.

In one advantageous embodiment, the injection nozzle 17 is cut at an acute angle of for instance 30° on the side facing the thermostat 15 so that the injected water is intentionally conducted to the floor of the evaporator 5.

In another very advantageous embodiment, the collector 8 is embodied as an open system and in this manner can be easily integrated structurally in an equipment housing.

Experiments have demonstrated that the open system provides good results, both with the baffle 11 and without it for simple applications.

In another embodiment, the pump 3 is a magnetic valve and the water is added from a water line. The pump 3 and the magnetic valve are switched by the thermostat 15 in that embodiment.

Experiments have demonstrated that the inventive device still provides good results when the steam hose 6 is 2 meters long. Because of this it is possible to guide the steam into locations that are difficult to access without there being problems related to formation of condensate in the steam hose 6, even with large pieces of equipment.

When the demands on the quality of the steam are less stringent, the system can also be employed without the collector 8.

Unpressurized operation of the system permits the evaporator 5 to be embodied in the simplest manner, e.g. from special steel sheet, which is particularly low in mass.

The invention claimed is:

1. Apparatus for evaporating calciferous water, comprising an electrically heated evaporator, a water hose, a pump, a spray hose, a steam hose, a pipe connector, a collector, a return connector, a return hose, an injection connector, a temperature regulating device, a steam connector, and a water container; and wherein the water container is connected to the electrically heated evaporator via the water hose, the pump, and the spray hose, said evaporator is connected via the steam hose to the pipe connector of the collector, the return connector is attached to a bottom of said collector, and the bottom of said collector is at an angle of inclination of 5° to 10° relative to horizontal, wherein the return hose leads into said water container and is arranged at said return connector, wherein the injection nozzle is connected to said spray hose and is arranged in an upper third of said evaporator immediately above the temperature regulating device disposed on a bottom of said evaporator, a distance between said injection nozzle and said temperature regulating device is less than 15 mm, said steam hose is connected to said evaporator via the steam connector having an inside diameter of at least 5 mm, and said steam hose is two meters long.

2. Apparatus in accordance with claim 1, wherein distance between said injection nozzle and said temperature regulating device is 5 mm to 10 mm.

3. Apparatus in accordance with claim 1, wherein a smallest cross-section of said injection nozzle is at an end thereof facing said temperature regulating device.

4. Apparatus in accordance with claim 1, wherein an end of said injection nozzle facing said temperature regulating device forms an acute angle of 30°.

5. Apparatus in accordance with claim 1, wherein said collector includes a baffle.

6. Apparatus in accordance with claim 1, wherein said evaporator is constituted on thin sheet specialty steel.

7. Apparatus in accordance with claim 1, wherein said pump comprises a magnetic valve.

8. Apparatus in accordance with claim 1, wherein the temperature regulating device is a thermostat.

9. Apparatus in accordance with claim 1, wherein the temperature regulating device is an electronic sensor and the apparatus further comprises an electronic switch which switches the pump in response to the electronic sensor.

* * * * *